United States Patent [19]

Tye

[11] 4,179,151

[45] * Dec. 18, 1979

[54] ANCHOR INSERT FOR EMBEDMENT IN A CONCRETE SLAB

[75] Inventor: Dennis W. Tye, Fremont, Calif.

[73] Assignee: Superior Concrete Accessories, Inc., San Diego, Calif.

[ * ] Notice: The portion of the term of this patent subsequent to Apr. 19, 1994, has been disclaimed.

[21] Appl. No.: 868,315

[22] Filed: Jan. 10, 1978

Related U.S. Application Data

[63] Continuation of Ser. No. 568,585, Apr. 16, 1975, abandoned, which is a continuation of Ser. No. 435,700, Jan. 23, 1974, abandoned.

[51] Int. Cl.[2] ..... B66C 1/66

[52] U.S. Cl. ..... 294/89; 52/125; 52/707

[58] Field of Search ..... 294/86 R, 89; 52/125, 52/699–701, 703, 704, 706–708, 711

[56] References Cited

U.S. PATENT DOCUMENTS

| | | | |
|---|---|---|---|
| 2,772,560 | 12/1956 | Neptune | 52/707 |
| 2,794,336 | 6/1957 | Ballou | 294/89 X |
| 3,195,278 | 7/1965 | Ballou | 52/125 X |
| 3,404,503 | 10/1968 | Courtois et al. | 294/89 X |
| 3,431,012 | 3/1969 | Courtois et al. | 294/86 R |
| 3,596,971 | 8/1971 | Courtois et al. | 294/89 |
| 3,712,014 | 1/1973 | Waerner | 52/707 |

*Primary Examiner*—Johnny D. Cherry
*Attorney, Agent, or Firm*—Norman H. Gerlach

[57] ABSTRACT

An improved anchor insert adapted to be embedded in a concrete slab for cooperation with a pick-up unit which includes a locking stem having a pair of lift shoulders extending from opposite sides of the stem, comprises a concrete-excluding hollow cage adapted to be emplaced within a form for a concrete slab for insertion of the locking stem and lift shoulders into the cage after pouring the slab, the cage including a pair of spaced apart shoulders on opposite sides of and spaced from the base of the cage, the shoulders being adapted for interengagement with the lift shoulders and also with a pair of anchor rod sections, and a pair of spaced apart anchor rod sections in such engagement, wherein the locking stem of a pick-up unit may be inserted in the cage and rotated for bringing the lift shoulders into lifting engagement with the cage shoulders, and a lifting force when imparted to the locking stem is transmitted to the anchor rod sections for lifting a slab in which the insert is embedded.

6 Claims, 7 Drawing Figures

ANCHOR INSERT FOR EMBEDMENT IN A CONCRETE SLAB

This is a continuation of application Ser. No. 568,585, filed Apr. 16, 1975, now abandoned, which in turn is a continuation of application Ser. No. 435,700, filed Jan. 23, 1974, now abandoned.

BACKGROUND OF THE INVENTION

This invention relates to an anchor insert adapted to be embedded in a concrete slab for cooperation with a pick-up unit which includes a locking stem having a pair of lift shoulders extending from opposite sides of the stem, to a concrete-excluding cage employed in such an insert, and to lifting apparatus constituting a combination of the anchor insert and such a pick-up unit.

The insert of the invention is designed for use primarily in connection with the relocation of a preformed concrete wall slab by a hoisting and tilting operation such as to lift the slab from an original horizontal position in which it was formed to a final vertical position which it will assume in constituting one wall of a concrete building installation. More particularly, the invention is concerned with an anchor insert and pick-up unit of the general type disclosed in U.S. Pat. No. 3,431,012. The present anchor insert is an improvement upon and provides advantages over the prior inserts.

An anchor insert is constructed of a plurality of rod or heavy wire sections which become embedded in a concrete slab and serve as anchor members for lifting the slab. A pick-up unit is provided for each anchor insert, and the unit is designed for releasably interengaging the insert. For the pick-up unit to engage the insert, it is necessary to shield portions of the insert from the surrounding concrete, and this has been accomplished by enclosing such portions in a concrete-excluding hollow cage, which may be constructed of plastic, metal or other suitable material. Hoisting apparatus is connected to the pick-up unit when the unit is engaged with the insert, and hoisting apparatus likewise may be connected to other similar pick-up unit and insert combinations disposed about the slab. The slab then may be raised from the horizontal position in which it is poured, to an upright position in which it may serve as a building wall, for example. The pick-up units are removed from their engagement with the inserts and may be used repeatedly with inserts in other slabs.

While the prior lifting apparatus of the type disclosed in the aforementioned patent is in widespread use, there remains room for improvement. In particular, the structure and assembly of the cage or can surrounding the thrust portions of the anchor rod sections in the insert of the patent render manufacture relatively laborious and time-consuming. It is necessary also to provide a good seal at each junction of the cage and an anchor rod, in order to prevent leakage of mortar into the cage, and the seal may not be reliable.

SUMMARY OF THE INVENTION

The present invention provides an anchor insert and a concrete-excluding cage therefor adapted to be embedded in a concrete slab for cooperation with a pick-up unit which includes a locking stem having a pair of lift shoulders extending from opposite sides of the stem, the cage comprising a hollow body and a base closing one end of the body, the opposite end of the body being adapted for insertion of the locking stem and lift shoulders into the cage, and the cage being adapted to be emplaced within a form for a concrete slab with its base lowermost in the form, and means defining a pair of spaced apart shoulders in the cage body on opposite sides of the body and spaced from the base, the body shoulders extending inwardly of the body to define a pair of downwardly facing internal thrust surfaces on the cage adapted for lifting engagement with the lift shoulders, the body shoulders also defining a pair of upwardly facing external lift surfaces on the cage each adapted for lifting engagement with a section of an anchor rod; the insert further comprising a pair of spaced apart anchor rod sections each defining a downwardly facing thrust surface engaging one of the lift surfaces on the cage body, whereby the locking stem of a pick-up unit may be inserted in the cage with the lift shoulders disposed beneath the body shoulders, the locking stem thereafter may be rotated and the lift shoulders may be brought into lifting engagement with the thrust surfaces on the body, and a lifting force when imparted to the locking stem is transmitted to the anchor rod sections for lifting a slab in which the insert is embedded.

The new anchor insert and cage therefor are advantageous in that they may be assembled with substantially greater ease and rapidity, thereby reducing labor, assembly time and production facilities. The assembled insert completely and reliably excludes mortar from the interior of the cage, without need for special sealing procedures and without danger of faulty sealing or subsequent loss of seal. These advantages result from the fact that no longer are the anchor rod sections inserted through the wall or walls of the cage, but the rod sections are secured externally of the cage and no openings into the cage need be provided.

In a preferred embodiment, the base of the cage is provided with feet attached thereto and which are adapted to seat on the floor of a slab form while extending below the anchor rod sections, to space such sections inwardly from the adjacent external surface of a formed slab. In this manner, the anchor rods are not exposed at the surface of the slab, and objectionable rusting caused by such exposure is avoided. Previously, sleeves were placed on the ends of the anchor rods for such purpose, and this required an additional operation.

In another preferred embodiment, the lift surfaces on the cage are arcuate for cooperation with complementarily arcuate anchor rod sections, and the anchor rod sections include portions extending from the arcuate portions at small angles from the vertical, to thereby cause a large component of the initial lifting force to be effectively applied in the vertical direction. Previously, the anchor rod sections extending through and adjacent to the cage were, in actual practice, in the form of relatively shallow or flat curves having large components of horizontal extension relative to their components of vertical extension. Consequently, much of the lifting force was applied as a horizontal pull on the rod sections, to thereby limit the safe working load. The new construction serves to substantially increase the component of the initial lifting force which is effectively exerted in the vertical direction, thereby providing a higher safe working load or capacity for the insert.

A further preferred embodiment of the invention provides flange members attached to the base of the cage for aligning the anchor rod sections, and it is additionally preferred that the aforesaid feet be provided on such flange members. The flange members serve to maintain the anchor rod sections in proper alignment during assembly of the insert and, together with the feet, provide support for the insert on the floor of the slab form. This structure is advantageous for expediting manufacturing and assembly operations.

BRIEF DESCRIPTION OF THE DRAWINGS

The attached drawings illustrate a preferred embodiment of the invention, without limitation thereto. In the drawings, like elements are identified by like reference symbols in each of the views, and:

FIG. 4 is a partly side elevational and partly broken and sectional view similar to FIG. 2, illustrating a cap assembled with the insert and the whole embedded in a concrete slab or the like;

DESCRIPTION OF THE PREFERRED EMBODIMENT

Figures 1, 2, 3:
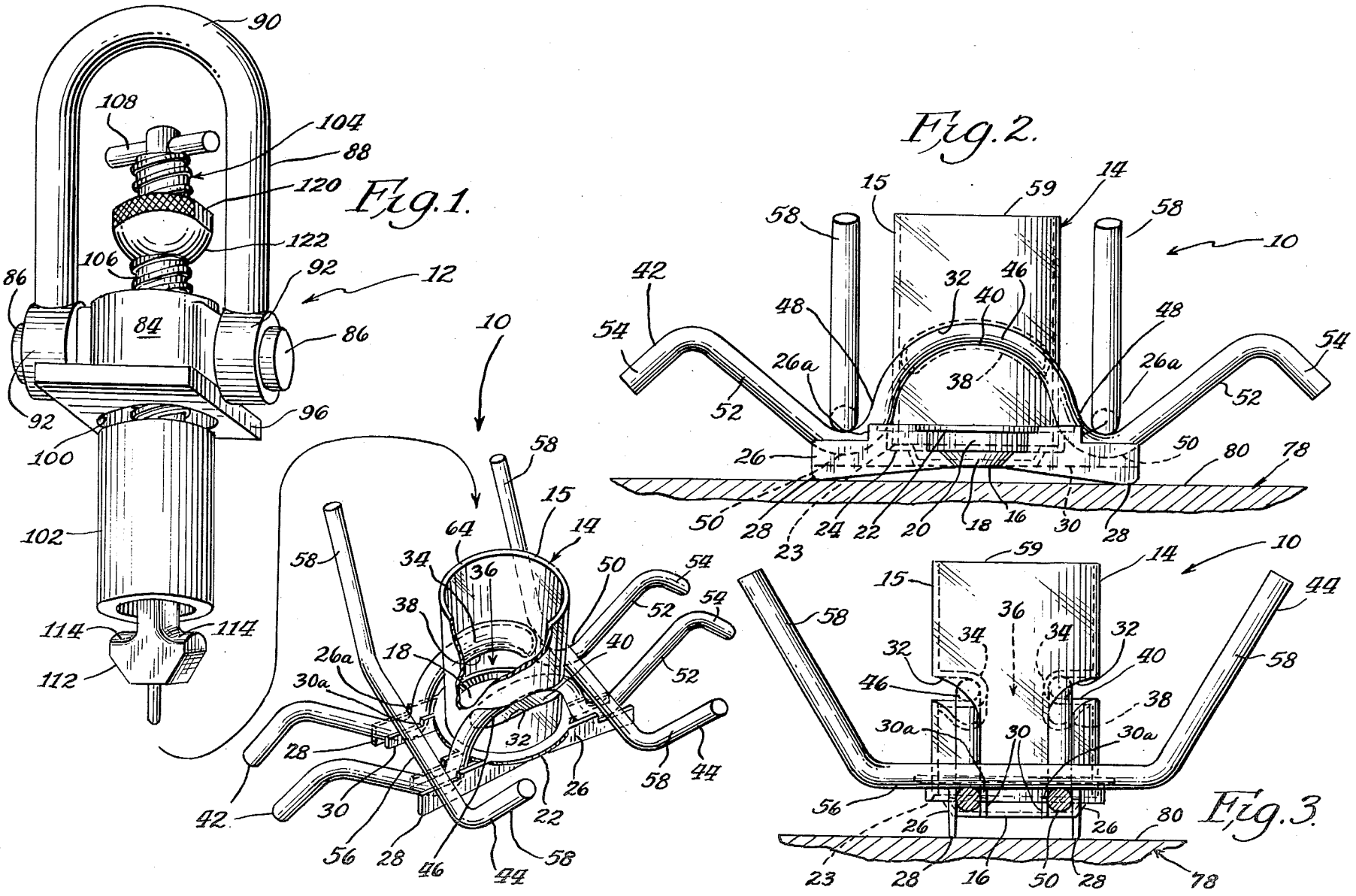
FIG. 1 is a perspective view of lifting apparatus constituting a combination of an anchor insert and a pick-up unit according to the invention, with the components separated as they appear prior to assembly or following disassembly, drawn to a smaller scale than in the remaining views.
FIG. 2 is a side elevational view of the anchor insert.
FIG. 3 is an end elevational and partly sectional view of the anchor insert.

Referring to FIGS. 1–3 of the drawings, representative apparatus for lifting a concrete slab includes the combination of an anchor insert 10 and a pick-up unit 12 constructed for interlocking engagement with each other. The pick-up unit 12 in the illustrative embodiment is essentially the same as the pick-up unit illustrated and described in U.S. Pat. No. 3,431,012 and there identified by the same reference numeral 12, with minor variations. The anchor insert 10 embodies the novel features of the invention. The insert 10 is designed to be embedded in multiple in a concrete slab, and a pick-up unit 12 is provided for each insert. After pouring the slab in a horizontal position and causing the inserts 10 to be embedded at suitable locations therein, a pick-up unit 12 is connected to each of the inserts, and hoisting mechanism is connected to each pick-up unit. The hoisting mechanism is operated to elevate the slab to its desired final upright position, after which the pick-up units 12 may be removed and reused with inserts 10 in other slabs. The inserts 10 remain in the slab, and access openings remaining in the slab are filled with grout, to complete the operation of erecting the slab.

The anchor insert 10 includes a concrete-excluding cage or can 14 which is a unitary structure of a hollow body or tube 15 and a base or bottom end closure 16. Except for shoulder structure, to be described, the cage body 15 is substantially cylindrical and tubular, with its opposite ends open. The base 16 is a shallow circular dish-like member having a frusto-conical bottom portion 18, a slightly enlarged cylindrical tubular upper portion 20 surmounting and integral with the bottom portion 18, and an integral outwardly projecting annular rim 22 serving to reinforce the structure. The lower rim or edge 23 of the body 15 fits within the upper portion 20 of the base 16 in a snug or friction fit, and seats on a shoulder 24 formed at the junction of the bottom portion 18 and the upper portion 20 of the base. A tight fit is provided, for the purpose of excluding mortar from the joint. For this purpose, the lower rim 23 and the adjoining parts of the base 16 also may be sealed together, such as by a suitable sealing and/or adhesive composition, or, in the case of plastic parts, by solvent welding or fusion.

On each side of the base 16, two aligned outer flange members 26 extend from opposite ends of the base, with the flange members on opposite sides of the base spaced apart and in parallel relation. The flange members serve for aligning anchor rod sections, as will appear subsequently. The flange members in the illustrative embodiment are integral and in one piece with the base 16. Each of the outer flange members 26 is provided with a foot 28 at its outer end, which constitutes a generally triangular portion integral and coplanar with the flange member. The feet 28 constitute the lowermost points on the insert 10 and serve to support the insert.

A pair of inner flange members 30 is provided on each side of the base 16, integral and in one piece with the base 16. The inner flange members in each pair extend from opposite ends of the base and in spaced parallel relation to the flanges on the opposite side of the base, similarly to the outer flange members 26. The inner flange members 30 also are parallel to the outer flange members 26, and are spaced inwardly therefrom for a distance approximately equal to the width of anchor rods which are included in the insert 10, as described subsequently. The outer and inner flange members 26 and 30 are provided with notches or recesses **26*a* and 30*a***, which accommodate the anchor rods.

The illustrative cage body 15 is molded or otherwise formed to provide a pair of arcuate grooves or recesses 32 in spaced parallel relation on opposite sides of the body. Referring to FIGS. 4–7, the grooves 32 in the cage body 15 are curved downwardly on a radius, and the walls 34 of the grooves are spaced apart to leave an access opening or passageway 36 (see FIGS. 1 and 3) between them within the body 15. The groove walls 34 provide a pair of spaced apart shoulders 37 on opposite sides of the cage body 15 and spaced from the bottom of the cage 14. The shoulders 37 extend inwardly to define spaced apart, parallel pairs of downwardly facing arcuate internal thrust surfaces 38 and upwardly facing external lift surfaces 40. As subsequently described, the thrust surfaces 38 are adapted for lifting engagement with lift shoulders on the pick-up unit 12, and the lift surfaces 40 are adapted for lifting engagement with sections of anchor rods.

The cage body 15, the cage base 16, the flange members 26 and 30, and the feet 28 may be constructed of a suitable plastic material, for example, polystyrene. Alternatively, the latter parts may be constructed of metal or of other materials. However, it is preferred that at least the feet 28 be constructed of plastic or other noncorrosive material, to avoid problems occasioned by the formation of rust on metal surfaces close to the external surface of the concrete slab. It is further preferred that the body 15, and the unit comprising the base 16, flange members 26 and 30, and feet 28, each be constructed integrally in one piece of molded material, such as a thermoplastic resin polymer.

As seen most clearly in FIGS. 1–3, the anchor insert 10 includes a pair of longitudinally extending spaced parallel anchor rods 42, and a pair of transversely extending spaced parallel anchor rods 44 fixed to the longitudinal rods 42. The anchor rods 42 and 44 provide the support for a concrete slab which is to be lifted, and the lifting forces are transmitted to the rods via the pick-up units 12 which are operatively connected to the rods during the lifting operation. The rods 42 and 44 are mounted on the cage 14 for emplacement within a concrete form, and the cage serves to exclude concrete from the connective portions of the anchor insert 10 and also to support the insert on the form for pouring concrete therearound.

The longitudinal anchor rods 42 are identical, and each includes a central portion 46 curving downwardly, when installed, substantially on the arc of a circle, a transition portion 48 extending from each of the opposite ends of the central portion 46, a reverse bend portion 50 extending from each transition portion, an upwardly and outwardly inclined extension portion 52 extending from each reverse bend portion 50, and a downwardly bent terminal portion 54 extending from each extension portion 52. The central portion 46 of each rod 42 is received relatively snugly within one of the grooves 32 in the cage body 15. The ends of the central portion 46 and the transition portions 48 extend at relatively small angles from the vertical, to thereby cause a large component of the initial lifting force to be exerted in the vertical direction, as will become evident subsequently. The entire rod structure is advantageously designed to achieve high safe working loads.

The transverse anchor rods 44 are identical, and each includes a straight, initially horizontal central portion 56, and two upwardly and outwardly inclined wing-like terminal portions 58 extending from the opposite ends of the central portion. The transverse rods 44 are disposed on opposite sides of the cage body 15, and the central portions 56 of the transverse rods are affixed to the upper surfaces of the reverse bend portions 50 of the longitudinal rods 42, in respective substantially perpendicular planes.

As assembled with the cage 14, the reverse bend portions 50 of the longitudinal rods 42 are embraced by respective adjacent outer and inner base flange members 26 and 30, which serve to maintain the longitudinal rods in substantially parallel longitudinal alignment. The upper surfaces of the reverse bend portions 50 are disposed above the flange members 26 and 30, in alignment with and above the notches 26*a* and 30*a* in the flange members. This structure and manner of assembly provides for connection of the transverse rods 44 to the longitudinal rods 42, and the flange members prevent significant rocker movement of the rods on the cage 14. The lower extent of each reverse bend portion 50 is spaced above the bottom of each adjacent foot 28, so that when a concrete slab is poured with the feet 28 on the floor of a slab form, the anchor rods 42 and 44 are spaced inwardly or upwardly from the adjacent external surface of the resulting slab.

The insert 10 may be assembled in a convenient manner by placing the longitudinal rods 42 in the grooves 32 of the cage body 15, followed by securing the base 16 on the body 15 in a manner such as to insert the reverse bend portions 50 of the rods 42 between the base flange members 26 and 30. Alternatively, the cage body 15 and the cage base 16 may be assembled first, and the longitudinal rods 42 may be mounted by inserting the reverse bend portions 50 between the flange members 26 and 30, and then rotating the central portion 46 of each longitudinal rod sufficiently to cause it to move into one of the grooves 32 in the cage body 15. Following either manner of assembling the foregoing parts, the transverse rods 44 are placed in their proper positions on top of the reverse bend portions 50 of the longitudinal rods 42 and are secured in place in a suitable manner, such as by resistance welding. In this connection, the anchor rods preferably are constructed of heavy steel wire stock which may be, for example, about 7/16" in diameter.

Figure 4:
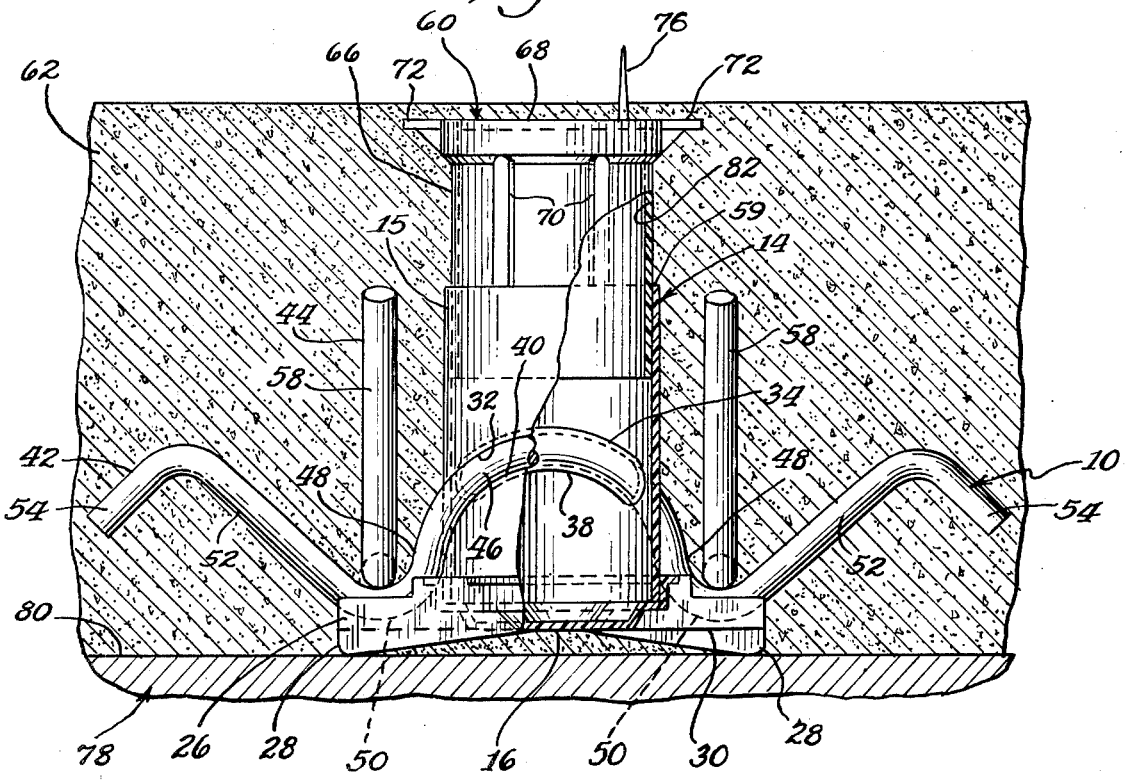

Referring to FIGS. 1–3, the cage body 15 is provided with an open upper rim or edge 59 which is adapted for insertion of components of the pick-up unit 12 into the body. Referring to FIG. 4, the insert 10 is assembled with a closure cap 60 for embedment in a tilt-up type concrete wall slab 62. The rim 59 also is adapted to receive the cap 60 telescopically, for closing the cage 14 to exclude concrete from the interior thereof when the slab 62 is poured.

The cap 60, generally conventional in structure, is a one-piece integral structure including a cylindrical tubular body 66, an upper end closure 68, a series of spaced longitudinally extending, externally embossed stops 70, and a pair of diametrically opposed attachment ears 72 secured to the end closure 68. The cap body 66 is received telescopically within the cage body 15 in close fitting, sealing contact, until the stops 70 abut upon the rim 59 of the cage body and limit further relative axial movement. In view of the tight fit, small perforations, not shown, are provided in the cap closure 68, to permit the escape of air during the closing, while not allowing any significant amount of mortar to enter the cage. The cap 60 also is provided with a locating prong or finger 76, which projects upwardly from the upper closure 68 and thereby serves to pinpoint the location of the insert 10 after the slab 62 is poured.

In use, a concrete slab form 78 having a floor or bottom wall 80 is erected in a desirable location, for pouring the horizontal slab 62. A suitable number of inserts 10 with assembled caps 60 is selected, according to load requirements, and the assemblies are properly located around the form 78. The assemblies are supported by the cage feet 28 seated on the floor 80, thereby spacing the anchor rods 42 and 44 upwardly from the floor. Wires are attached to the ears 72 on the cage 60 and also to adjacent reinforcing bars (not shown), to secure the inserts in place. Concrete then is poured into the form 78, until it reaches the upper level of the cap closure 68, and immerses the cap in a thin layer of the concrete, e.g., about ¼ inch. After the concrete hardens, the closure 68, desirably made of plastic or other ductile material, is punctured, and the cap 60 is pried loose from the wall of the resulting hole 82 in the slab 62, to expose the interior of the cage 14. The ears 72 break off during removal of the cap 60.

Figure 6:
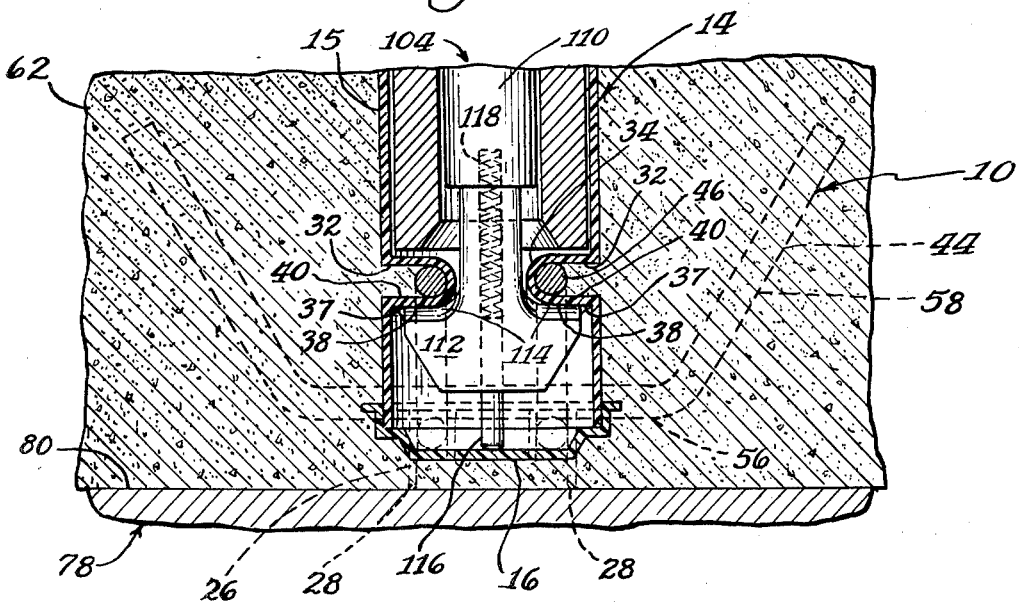
FIG. 6 is a fragmentary vertical sectional view of the lower end of the assembly of FIG. 5, taken substantially on line 6—6 thereof.
Figure 7:
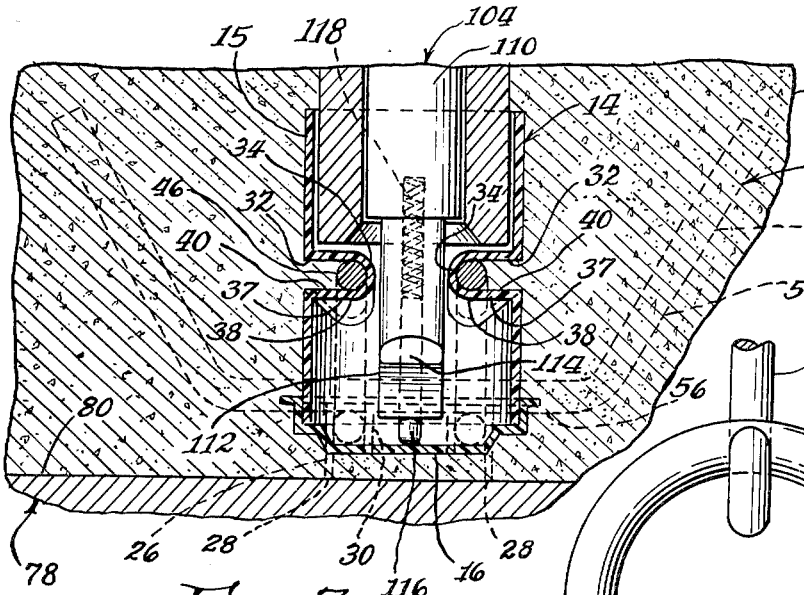
FIG. 7 is a view like FIG. 6, but showing the locking stem and lift shoulders of the pick-up unit depressed and rotated 90° from their positions in FIG. 6.
Figure 5:
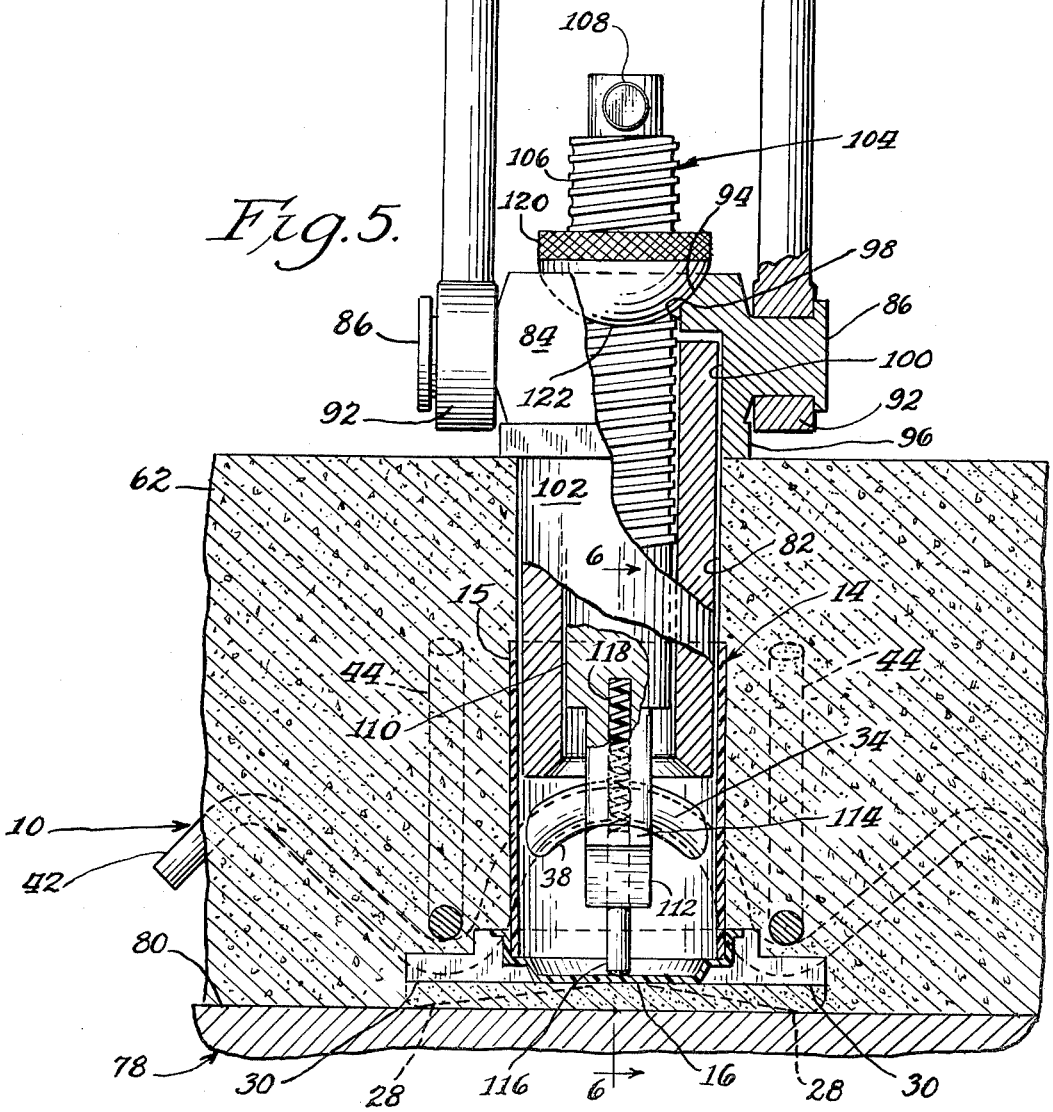
FIG. 5 is a view similar to FIG. 4, but with the cap removed and showing an assembly of the pick-up unit engaging the anchor insert, with certain parts broken away and in section.

A pick-up unit 12 is inserted into each of the holes 82 for interlocking engagement with an insert 10, as illustrated in FIGS. 5–7. Referring also to FIG. 1, the conventional pick-up unit 12, as described in U.S. Pat No. 3,431,012, includes a generally tubular body 84 having a pair of diametrically exposed integral trunnions 86 extending outwardly therefrom. A lifting bale 88 having a bight 90 and a pair of terminal eyelets 92 is pivotally secured on the trunnions 86, which project through the eyelets. The body 84 is surmounted by a frusto-spherical seat 94. A flat, rectangular bearing plate 96 is integral with the base of the body 84. The body is provided with an upper circular bore 98 which is surrounded by the seat 94, and a lower circular counterbore 100 extending from the bearing plate 96 to a location adjacent to the seat 94. A cylindrical bearing sleeve 102 is loosely received in the counterbore 100.

A locking torque stem 104 is inserted through the bores 98 and 100 of the body 84, and through the sleeve 102, fitting loosely therein. The stem 104 includes an outer or upper rolled or contour thread portion 106 having an operating handle 108 secured thereto, and a cylindrical lower shank portion 110. A T-head 112 is attached to the lower end of the shank portion, and it includes a pair of transversely arcuate lift shoulders 114, rounded or having contours in general complementary to those of the cage thrust surfaces 38. The T-head 112 is oblong, and it extends in the direction of the lift shoulders 114 radially outwardly from the axis of the stem 104, for a diameter or width at least equal to the corresponding diameter of the thrust surfaces 38. In a direction transverse thereto, the width of the T-head 112 is less than the width of the opening 36 between the walls 34 of the grooves 32, so that the T-head 112 will pass between such walls when the head is properly oriented.

A plunger or pin 116 is vertically slidably mounted in a corresponding opening in the T-head 112, and it is urged outwardly at the bottom of the T-head by a compression spring 118 held captive within the shank 110 and resiliently bearing upon the inner end of the plunger. A lock nut 120 is received on the threaded portion 106 of the stem 104, and it is provided with a spherically curved bottom 122 which is adapted for turning on the seat 94 on the body 84.

The pick-up unit 12 is connected to the anchor insert 10 by inserting the sleeve 102 into the hole 82 in the slab 62. The operating handle 108 is oriented so that the T-head 112 is in the rotational position shown in FIG. 7, enabling the T-head to pass between the walls 34. The stem 104 is supported by the plunger 116, which is seated on the base 16. The operator presses on the handle 108 to depress the stem 104 against the tension of the spring 118, and move the T-head 112 to a position beneath the projecting walls 34, as illustrated in FIG. 7. The handle 108 then is rotated through an angle of 90° and released, whereupon the T-head 112 enters the position illustrated in FIGS. 5 and 6. At this time, the lift shoulders 114 of the T-head are in lifting engagement with the thrust surfaces 38. The lift surfaces 40 are in lifting engagement with the downwardly facing thrust surfaces on the lower sides of the central portions 46 of the longitudinal rods 42. Next, the lock nut 120 is threaded down on the stem 104 until it reaches the seat 94, and then it is backed off slightly to permit free relative rotation of the parts. Thereafter, a hoisting hook 124 (FIG. 5) may be connected to the bight 90 of the bale 88 to begin a lifting sequence.

Each pick-up unit 12 connected to an anchor insert 10 in the slab 62 is hooked in this manner, and hoisting apparatus is employed to raise the concrete slab 62 thereby. Ultimately, the slab is raised to a vertical position, while the bales 88 turn on the trunnions 86 as the slab changes its angular relation to the hoisting apparatus. When the slab has been elevated to its final position, each pick-up unit 12 may be removed by exerting inward pressure on the operating handle 108 and turning the locking stem 104 and the T-head 112 through an angle of 90°, as illustrated in FIG. 7, and pulling the bale 88 outwardly. The hole 82 remaining in the slab 62 is filled with grout, to finish the surface of the slab.

The invention thus provides an anchor insert 10 which includes a cage 14 that is adapted for rapid and economical manufacture and assembly. The structure most conveniently is manufactured in two pieces, constituting the body 15 and the base 16 with attached flange members 26 and 30, and feet 28, and the two pieces are secured together in the process of assembling the insert. Alternatively, the entire cage 14 may be manufactured in one piece, such as by molding and together with the flange members 26 and 30, and the feet 28, if desired. Such manufacture of the cage may be especially desirable, for example, when other modifications of the base of the cage are employed, e.g., a simpler modification of the type illustrated in the aforementioned U.S. Pat. No. 3,431,012. The illustrative embodiment is, however, very advantageous, for the reasons set forth above, and is preferred.

The anchor rods 42 and 44 are easily and rapidly mounted on the cage 14 to form the insert 10. The insert structure completely and reliably excludes mortar from the interior of the cage. The insert 10 also is advantageous in providing for the transmission to the anchor rods of the initial lifting forces effectively with relatively large vertical components of force and relatively small horizontal components of force, thereby providing a relatively high safe working load for the insert.

While a preferred embodiment of the invention has been illustrated and described, it will be apparent to those skilled in the art that various changes and modifications may be made therein within the spirit and scope of the invention. It is intended that such changes and modifications be included within the scope of the appended claims.

Having thus described the invention, what we claim as new and desire to secure by Letters Patent is:

1. An anchor insert adapted to be embedded in a concrete slab for cooperation with a pick-up unit which includes a locking stem having a pair of lift shoulders extending from opposite sides of the stem, said insert comprising:

a concrete-excluding cage which includes a single-walled hollow body and a base closing one end of the body, the opposite end of said body being adapted for insertion of said locking stem and lift shoulders into the cage, said cage being adapted to be emplaced within a form for a concrete slab with its base lowermost in the form, a pair of spaced apart shoulders formed in the wall of said cage body on opposite sides of the body and spaced from said base, said body shoulders extending inwardly of the body to define a pair of downwardly facing internal thrust surfaces on one side of said wall each adapted for lifting engagement in contact with one of said lift shoulders, said body shoulders also defining a pair of upwardly facing external lift surfaces on the reverse side of said wall each adapted for lifting engagement in contact with a section of an anchor rod, a pair of spaced apart anchor rod sections each defining a downwardly facing thrust surface contacting one of said lift surfaces on the body, flange members attached to said base and extending outwardly therefrom, and feet provided on said flange members and adapted to seat on the floor of a slab form and extending below the anchor rod sections to space such sections inwardly from the adjacent external surface of a formed slab, whereby said locking stem of a pick-up unit may be inserted in said cage with said lift shoulders disposed beneath said body shoulders, said lift shoulders may be brought into lifting engagement in contact with said thrust surfaces on the body, and a lifting force when imparted to said locking stem is transmitted to said anchor rod sections for lifting a slab in which the insert is embedded.

2. An anchor insert as claimed in claim 1 and wherein each of said cage body and said cage base with attached flange members and feet is a one-piece molded plastic element, and the said cage body and said cage base are secured together at a substantially mortar-tight joint.

3. An anchor insert adapted to be embedded in a concrete slab for cooperation with a pick-up unit which includes a locking stem having a pair of lift shoulders extending from opposite sides of the stem, said insert comprising:

a concrete-excluding cage which includes a single-walled hollow body and a base closing one end of the body, the opposite end of said body being adapted for insertion of said locking stem and lift shoulders into the cage, said cage being adapted to be emplaced within a form for a concrete slab with its base lowermost in the form, a pair of spaced apart single-walled shoulders formed in the wall of said cage body on opposite sides of the body and spaced from said base, said body shoulders extending inwardly of the body to define a pair of downwardly facing downwardly curved arcuate internal thrust surfaces on one side of said wall each adapted for lifting engagement in contact with one of said lift shoulders, said body shoulders also defining a pair of upwardly facing downwardly curved arcuate external lift surfaces on the reverse side of said wall each adapted for lifting engagement in contact with a section of an anchor rod, a first pair of spaced apart anchor rod sections each including a central portion defining a downwardly facing thrust surface contacting one of said lift surfaces on the body, a transition portion extending from each of the opposite ends of the central portion, a reverse bend portion extending from each transition portion, an extension portion extending from each reverse bend portion, and a terminal portion extending from each extension portion, said central portions each being curved downwardly substantially on the arc of a circle and having ends extending downwardly and outwardly at small angles from the vertical, and said transition portions extending downwardly and outwardly at small angles from the vertical, thereby to provide for the transmission to the anchor rod sections of initial lifting forces with relatively large vertical components of force and relatively small horizontal components of force, said extension portions extending upwardly and outwardly, said terminal portions extending downwardly and outwardly, a second pair of spaced apart anchor rod sections extending transversely of said first pair of anchor rod sections and fixedly secured thereto on opposite sides of said cage body, said pairs of anchor rod sections thereby being securely mounted on said cage, flange members attached to said base and extending outwardly therefrom, and feet provided on said flange members and adapted to seat on the floor of a slab form and extending below the anchor rod sections to space such sections inwardly from the adjacent external surface of a formed slab, whereby said locking stem of a pick-up unit may be inserted in said cage with said lift shoulders disposed beneath said body shoulders, said lift shoulders may be brought into lifting engagement in contact with said thrust surfaces on the body, and a lifting force when imparted to said locking stem is transmitted to said anchor rod sections for lifting a slab in which the insert is embedded.

4. A concrete-excluding cage for an anchor insert adapted to be embedded in a concrete slab for cooperation with a pick-up unit which includes a locking stem having a pair of lift shoulders extending from opposite sides of the stem, said cage comprising:

a single-walled hollow body and a base closing one end of the body, the opposite end of said body being adapted for insertion of said locking stem and lift shoulders into the cage, said cage being adapted to be emplaced within a form for a concrete slab with its base lowermost in the form, a pair of spaced apart shoulders formed in the wall of said body on opposite sides of the body and spaced from said base, said body shoulders extending inwardly of the body to define a pair of downwardly facing internal thrust surfaces on one side of said wall each adapted for lifting engagement in contact with one of said lift shoulders, said body shoulders also defining a pair of upwardly facing external lift surfaces on the reverse side of said wall each adapted for lifting engagement in contact with a section of an anchor rod, flange members attached to said base and extending outwardly therefrom, and feet provided on said flange members and adapted to seat on the floor of a slab form, whereby each of a pair of spaced apart rod sections each defining a downwardly facing thrust surface may be mounted with its thrust surface in contact with one of said lift surfaces on the body thereby providing an anchor insert, said feet extending below the anchor rod sections to space such sections inwardly from the adjacent external surface of a formed slab, and whereby said locking stem of a pick-up unit may be inserted in said cage with said lift shoulders disposed beneath said body shoulders, said lift shoulders may be brought into lifting engagement in contact with said thrust surfaces on the body, and a lifting force when imparted to said locking stem is transmitted to said anchor rod sections for lifting a slab in which the insert is embedded.

5. A cage as claimed in claim 4 and wherein each of said body and said base with attached flange members and feet is a one-piece molded plastic element, and said body and said base are secured together at a substantially mortar-tight joint.

6. An anchor insert adapted to be embedded in a concrete slab for cooperation with a pick-up unit which includes a locking stem having a pair of lift shoulders extending from opposite sides of the stem, said insert comprising:

a concrete-excluding cage which includes a single-walled hollow body and a base closing one end of the body, the opposite end of said body being adapted for insertion of said locking stem and lift shoulders into the cage, said cage being adapted to be emplaced within a form for a concrete slab with its base lowermost in the form, a pair of spaced apart single-walled shoulders formed in the wall of said cage body on opposite sides of the body and spaced from said base, said body shoulders extending inwardly of the body to define a pair of downwardly facing downwardly curved arcuate internal thrust surfaces on one side of said wall each adapted for lifting engagement in contact with one of said lift shoulders, said body shoulders also defining a pair of upwardly facing downwardly curved arcuate external lift surfaces on the reverse side of said wall each adapted for lifting engagement in contact with a section of an anchor rod, a first pair of spaced apart anchor rod sections each including a central portion defining a downwardly facing thrust surface contacting one of said lift surfaces on the body, a transition portion extending from each of the opposite ends of the central portion, a reverse bend portion extending from each transition portion, an extension portion extending from each reverse bend portion, and a terminal portion extending from each extension portion, said central portions each being curved downwardly substantially on the arc of a circle and having ends extending downwardly and outwardly at small angles from the vertical, and said transition portions extending downwardly and outwardly at small angles from the vertical, thereby to provide for the transmission to the anchor rod sections of initial lifting forces with relatively large vertical components of force and relatively small horizontal components of force, and extension portions extending upwardly and outwardly, said terminal portions extending downwardly and outwardly, and a second pair of spaced apart anchor rod sections extending transversely of said first pair of anchor rod sections and fixedly secured thereto on opposite sides of said cage body, said pairs of anchor rod sections thereby being securely mounted on said cage, whereby said locking stem of a pick-up unit may be inserted in said cage with said lift shoulders disposed beneath said body shoulders, said lift shoulders may be brought into lifting engagement in contact with said thrust surfaces on the body, and a lifting force when imparted to said locking stem is transmitted to said anchor rod sections for lifting a slab in which the insert is embedded.

* * * * *